US009564257B2

(12) United States Patent
Karlen et al.

(10) Patent No.: US 9,564,257 B2
(45) Date of Patent: Feb. 7, 2017

(54) LITZ WIRE TERMINAL ASSEMBLY

(71) Applicant: Hamilton Sundstrand Corporation, Charlotte, NC (US)

(72) Inventors: Eric Karlen, Rockford, IL (US); John Horowy, Rockford, IL (US); Lawrence D. Hughes, Rockford, IL (US); Frank Z. Feng, Loves Park, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 92 days.

(21) Appl. No.: 14/557,936

(22) Filed: Dec. 2, 2014

(65) Prior Publication Data

US 2016/0155538 A1 Jun. 2, 2016

(51) Int. Cl.

| | |
|---|---|
| ***H01B 7/30*** | (2006.01) |
| ***H01R 4/18*** | (2006.01) |
| ***H01B 13/00*** | (2006.01) |
| ***H01R 4/02*** | (2006.01) |
| ***H01R 43/02*** | (2006.01) |
| *H01R 11/28* | (2006.01) |

(52) U.S. Cl.

CPC ..... *H01B 7/306* (2013.01); *H01B 13/00* (2013.01); *H01R 4/027* (2013.01); *H01R 4/18* (2013.01); *H01R 43/0263* (2013.01); *H01R 11/28* (2013.01)

(58) Field of Classification Search

USPC ..... 174/27; 439/330; 206/103

See application file for complete search history.

(56) References Cited

U.S. PATENT DOCUMENTS

| | | | | |
|---|---|---|---|---|
| 5,445,544 | A * | 8/1995 | Weiland | H01R 4/22 439/879 |
| 6,066,799 | A * | 5/2000 | Nugent | H01B 11/002 174/113 R |
| 2002/0153157 | A1* | 10/2002 | Harger | H01R 4/646 174/78 |
| 2002/0170735 | A1* | 11/2002 | Broad | H02G 15/184 174/84 R |
| 2006/0081388 | A1* | 4/2006 | Spath | H01B 9/006 174/27 |
| 2011/0209900 | A1* | 9/2011 | Roath | H01R 9/035 174/250 |

* cited by examiner

*Primary Examiner* — William H Mayo, III
*Assistant Examiner* — Krystal Robinson
(74) *Attorney, Agent, or Firm* — Cantor Colburn LLP

(57) ABSTRACT

A Litz wire terminal assembly includes a wire bundle having a plurality of electrically conductive strands extending between a first end and a second end to define a length. Each strand includes an insulative cover having a proximate cover end at the first end and a distal cover end at the second end. The distal cover end is flush with the second end. The Litz wire terminal assembly further includes a ferrule on the wire bundle. The ferrule has a distal ferrule end at the second end of the conductive strands.

13 Claims, 6 Drawing Sheets

LITZ WIRE TERMINAL ASSEMBLY

TECHNICAL FIELD

The invention relates generally to Litz wires, and more particularly, to Litz wire terminal assemblies.

BACKGROUND

Litz wires are typically selected and used as a means of reducing or eliminating skin effect that can occur in electrical conductors (e.g., wires) that are implemented in high-frequency power devices. A conventional Litz wire consists of several individually insulated wire strands that are twisted or braided together according to various prescribed patterns and orientations to form a larger bundle. The braid pattern increases the amount of surface area without significantly increasing the size of the conductor such that current flow is uniformly distributed through the bundle at high frequencies. Accordingly, the braid pattern reduces the skin effect realized by the conductor when energy is being transmitted at high frequencies.

Conventional Litz wire terminal assemblies require the removal of wire insulation and also require that the Litz wire bundle be straightened to expand the volume of conductive material, i.e., wire strands. Straightening the bundle alters the braid pattern, thereby eliminating the beneficial effects of Litz wire which can cause the conductor to heat up due to the skin effect. Generating heat near the wire terminations decreases the efficiency of the device or component and makes the overall termination connections more susceptible to failure from thermal cycling. Other conventional methods have resorted to using chemical baths to remove the insulation of each individual wire strand without splaying the braid pattern. The chemical baths, however, can damage the wires thereby reducing the overall performance of the Litz wire.

SUMMARY

According to a non-limiting embodiment, a Litz wire terminal assembly includes a wire bundle having a plurality of electrically conductive strands extending between a first end and a second end to define a length. Each strand includes an insulative cover having a proximate cover end at the first end and a distal cover end at the second end. The distal cover end is flush with the second end. The Litz wire terminal assembly further includes a ferrule on the wire bundle. The ferrule has a distal ferrule end at the second end of the conductive strands.

According to another non-limiting embodiment, a method of forming a Litz wire terminal assembly comprises forming a wire bundle including a plurality of electrically conductive strands extending between a first end and a second end. Each strand includes an insulative cover having a proximate cover end at the first end and a distal cover end at the second end. The distal cover end being end is flush with the second end of the strands. The method further includes forming a ferrule on the wire bundle. The ferrule extends between a proximate ferrule end and a distal ferrule end at the second end of the wire bundle such that an excess portion of the second ends of the strands extend beyond the distal ferrule end. The method further includes cutting the excess portion to form a substantially flat bundle surface, and welding the bundle surface to an electrically conductive surface.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Various embodiments of the invention provide a Litz wire termination assembly that maintains the braid pattern at the termination end without the need for splaying a portion of the wire bundle. In this manner, the original braid pattern is maintained leading to significant performance enhancements including, for example, increased protection against skin effects. Various embodiments of the disclosure also provide cost reductions associated with the inventive Litz wire terminal assembly. For example, the ultrasonic weld used to form the electrically conductive bond between the Litz wire and a metal surface will take considerably less time than conventional methods. Moreover, the Litz wire terminal assembly according to various embodiments of the invention eliminates the need to use chemical baths to remove the insulation of each wire strand. Accordingly, the integrity of the individual wires included in the wire bundle is maintained thereby improving the overall performance of the inventive Litz wire.

Figure 1:
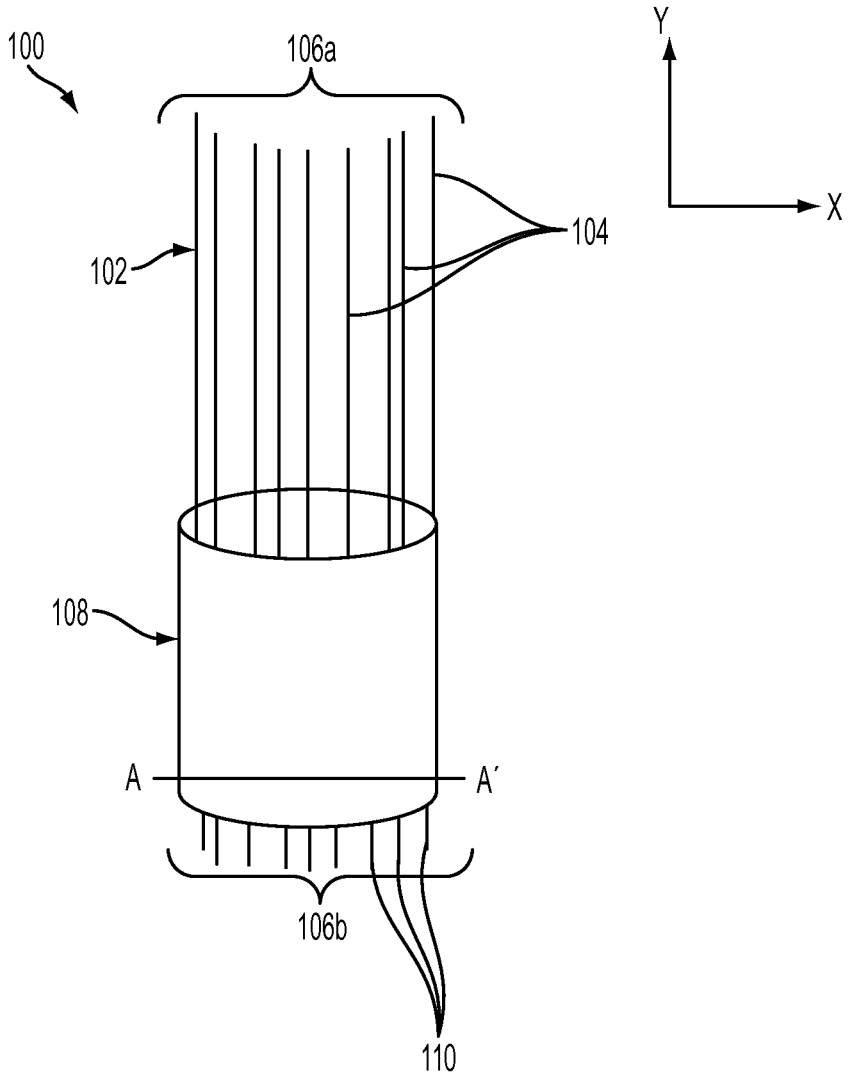
FIG. 1 is a perspective view of a ferrule formed on a portion of a wire bundle and a portion of conductive strands of the wire bundle extending beyond a distal end of the ferrule.

With reference to FIG. 1, a Litz wire terminal assembly 100 is illustrated according to a non-limiting embodiment. The Litz wire terminal assembly 100 includes a wire bundle 102 comprising a plurality of individual electrically conductive strands 104, such as metal wire strands for example. The strands 104 extend between a first end 106*a* and a second end 106*b* to define a length extending along the Y-axis, for example. The conductive strands 104 may comprise various metals including, but not limited to, copper. The first end 106*a* and the second end 106*b* define a proximate bundle end and a distal end of the wire bundle 102. Each conductive strand 104 includes an insulative covering thereby electrically insulating each conductive strand 104 from one other as understood by one of ordinary skill in the art. The insulative coverings have a proximate cover end located adjacent at the first end 106*a* of the conductive strands 104 and a distal cover end located adjacent at the second end of the conductive strands 104. According to an embodiment, the distal cover ends of the insulative coverings are flush with the second end 106*b* of a respective conductive strand 104. The conductive strands 104 are arranged according to a braid pattern that defines a shape of the wire bundle 102. The wire bundle 102 may be formed according to various braid patterns to form a Litz wire configured to mitigate skin effect at high frequencies as understood by one of ordinary skill in the art.

The Litz wire terminal assembly 100 further includes a ferrule 108 formed on the wire bundle 102. The ferrule 108 may be formed from various metal materials including, but not limited to, copper. The ferrule 108 extends between a proximate ferrule end and a distal ferrule end such that an excess portion 110 of the second ends 106*b* of the strands 104 extends beyond the distal ferrule end of the ferrule 108. According to an embodiment, the shape of the wire bundle 102 is substantially uniform between the proximate bundle end and the distal bundle end. Although the wire bundle 102 is shown to have a cylindrical shape, it is appreciated that the shape of the wire bundle is not limited thereto.

Figure 2:
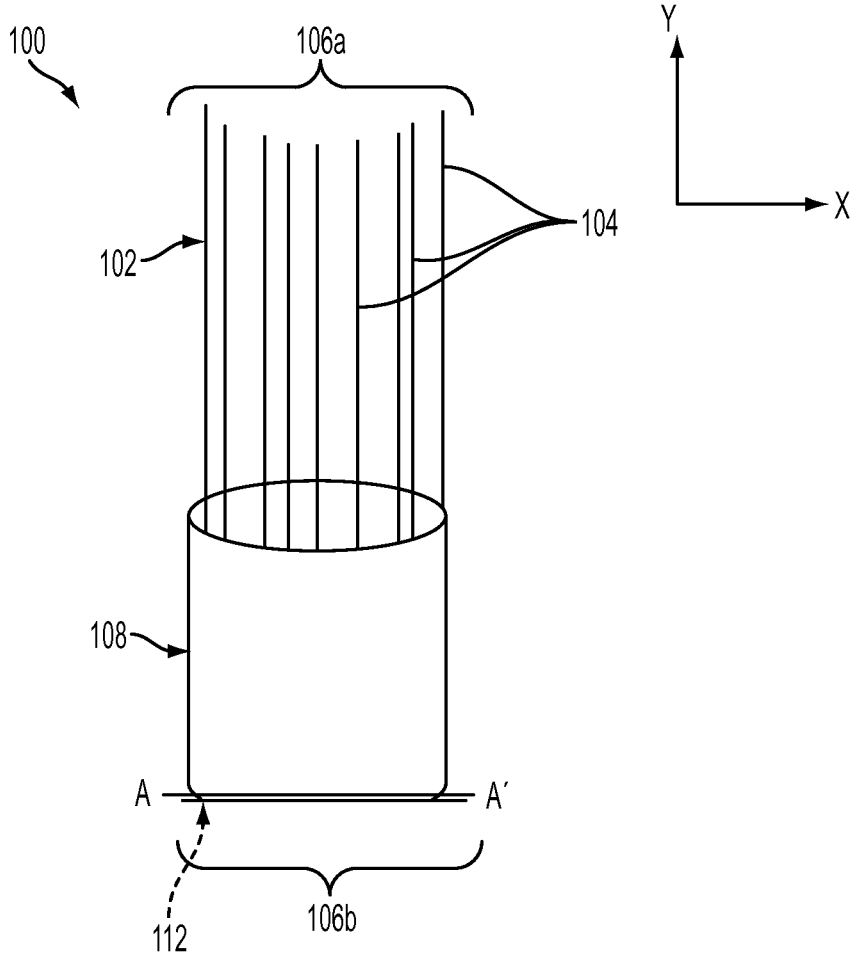
FIG. 2 is a perspective view of the ferrule illustrated in FIG. 1 following a cutting process that cuts the ferrule and the wire bundle along line A-A.
Figure 3:
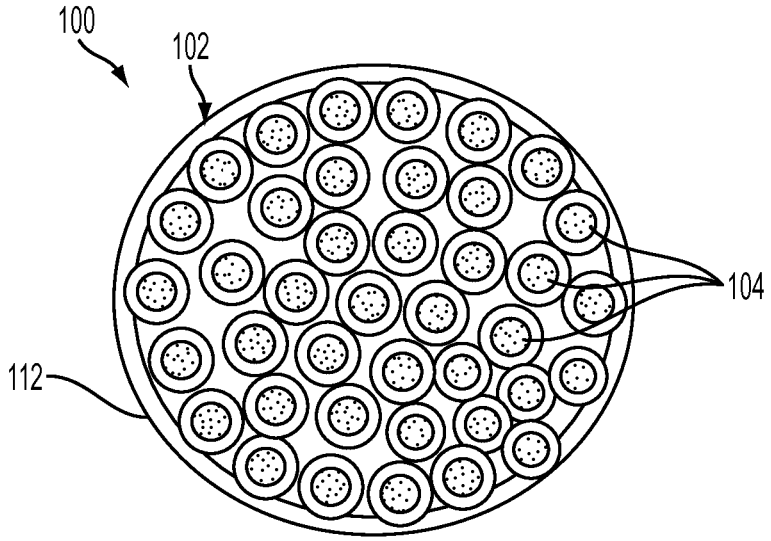
FIG. 3 is a cross-sectional view of the wire bundle and ferrule taken along line A-A' to define a flat bundle surface.

Turning now to FIG. 2, the ferrule 108 is illustrated following a cutting process that cuts the ferrule 108 and the wire bundle 102 along line A-A'. Various cutting processes understood by one of ordinary skill in the art may be used to cut through the ferrule 108 and the wire bundle 102 such that the excess portion 110 is removed. In this manner, the distal ferrule end is located at the distal bundle end of the wire bundle 102 and is flush with both the second end 106*b* of the conductive strands 104 and the distal cover ends of the insulative covers. The cutting process further forms a substantially flat cross-section at the distal end of the wire bundle 102 (see FIG. 3). The flat cross-section at the distal end defines a bundle surface 112. According to a non-limiting embodiment, the bundle surface 112 is perpendicular to the length of the ferrule 108. According to a non-limiting embodiment, the cross-section defines a circumference of the distal bundle end. A polishing process (not shown) may also be applied to the distal end of the wire bundle 102 following the cutting process to clean and smoothen the cut portion of the strands 104 as understood by one of ordinary skill in the art.

Figure 4:
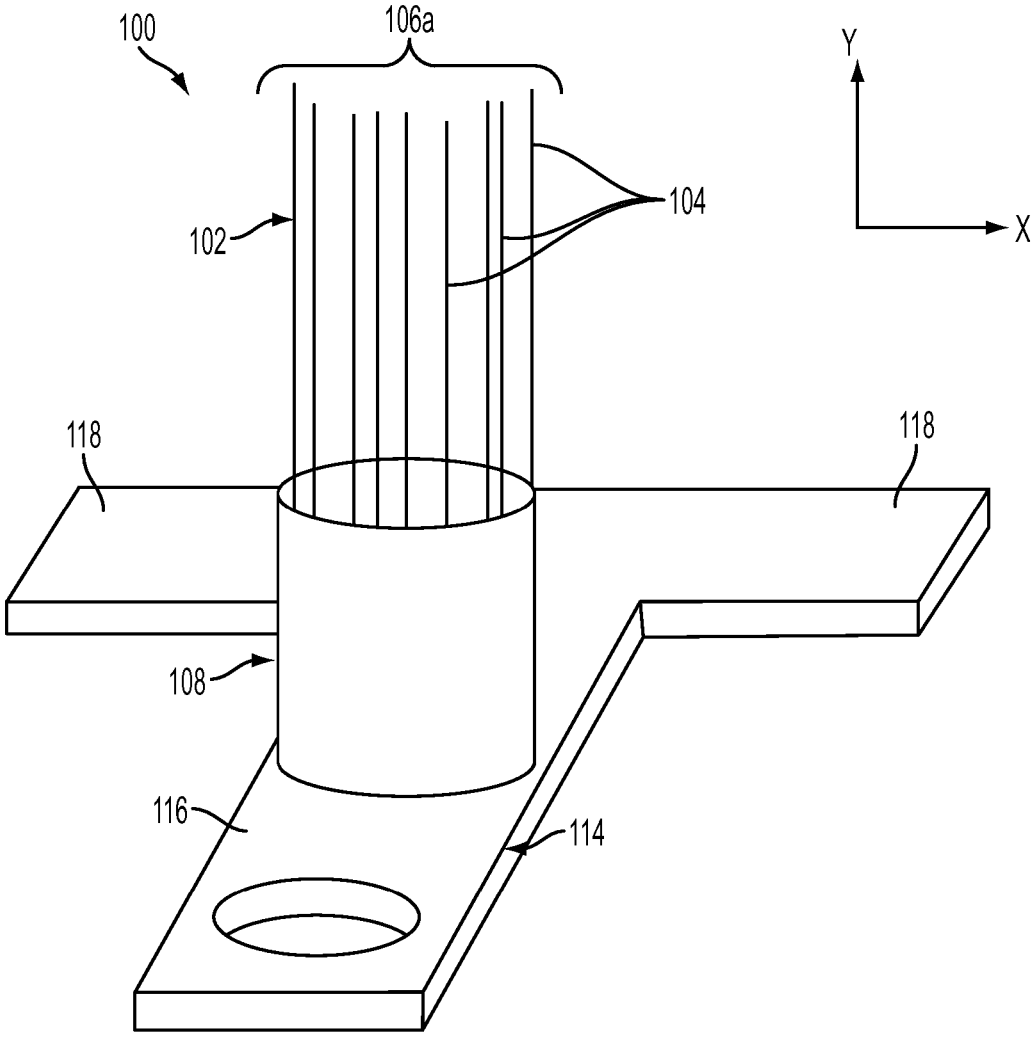
FIG. 4 illustrates the flat bundle surface of the wire bundle disposed against a flat surface of an electrically conductive lug.

According to a non-limiting embodiment shown in FIG. 4, the Litz wire terminal assembly 100 may include an electrically conductive lug 114 having a metal surface 116 and one or more flanges 118. The metal surface 116 is formed against the bundle surface 112. According to a non-limiting embodiment, the metal surface 116 is formed against the bundle surface such that the metal surface 116 is perpendicular with respect to the length of the wire bundle 102 (e.g., in the Y-axis direction). The lug 114 may be formed of various metal materials including, but not limited to, copper. Typically, the material of the lug 114 matches the material of the conductive strands 104. The invention, however, is not limited thereto, and material of the lug 114 may be different from the material of the conductive strands 104. Although a lug 114 is described going forward, it is appreciated that the lug 114 may be replaced with any metal surface. In this manner, the wire bundle 102 can be metallurgically bonded directly to a metal surface such as a bus bar or electrical contact pad, for example, thereby eliminating the use of additional bolts or rivets currently required by conventional Litz wire connections.

Figure 5:
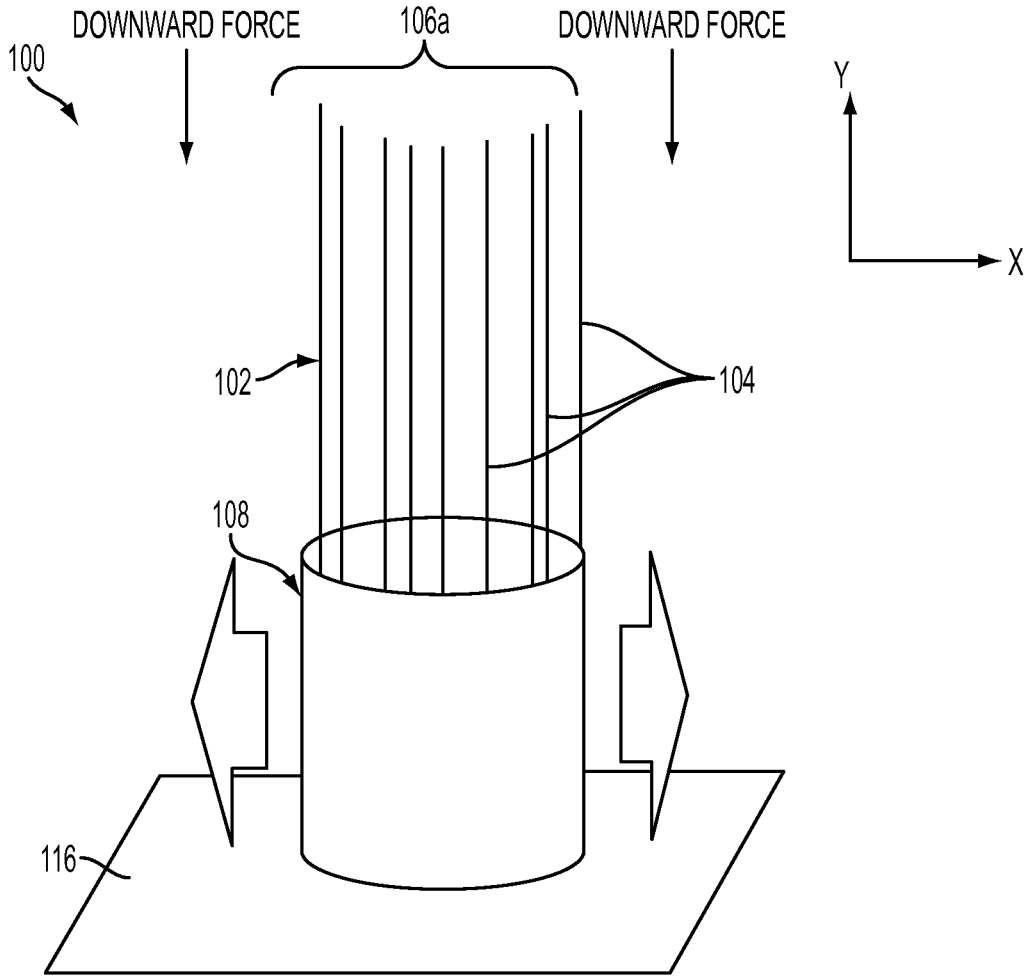
FIG. 5 illustrates a movement of the wire bundle with respect to the flat surface during a thermal adhesion process that forms a metallurgical bond between the wire bundle and the lug.

Referring now to FIG. 5, a metallurgical bonding process is illustrated that results in the distal bundle end (i.e., the second end 106*b* of the wire strands 104) being thermally adhered to the metallic surface. The metallurgical bonding process includes applying a downward force on the wire bundle 102 to force the bundle surface 112 against the metal surface 116 of the lug 114, while also rapidly moving the bundle surface 112 back and forth against the metal surface 116. The rapid frictional contact generates an ultrasonic weld between the metal surface 116 and the conductive strands 104. In this manner, a metallurgical bond is created between wire bundle 102 (i.e., the wire strands 104) and the metallic surface 116 without applying conductive solder used according to well-known conventional soldering processes. According to a non-limiting embodiment, the bundle surface 112 is welded against the metal surface 116 such that the metal surface 116 is perpendicular to a length of the ferrule 108.

Figure 6:
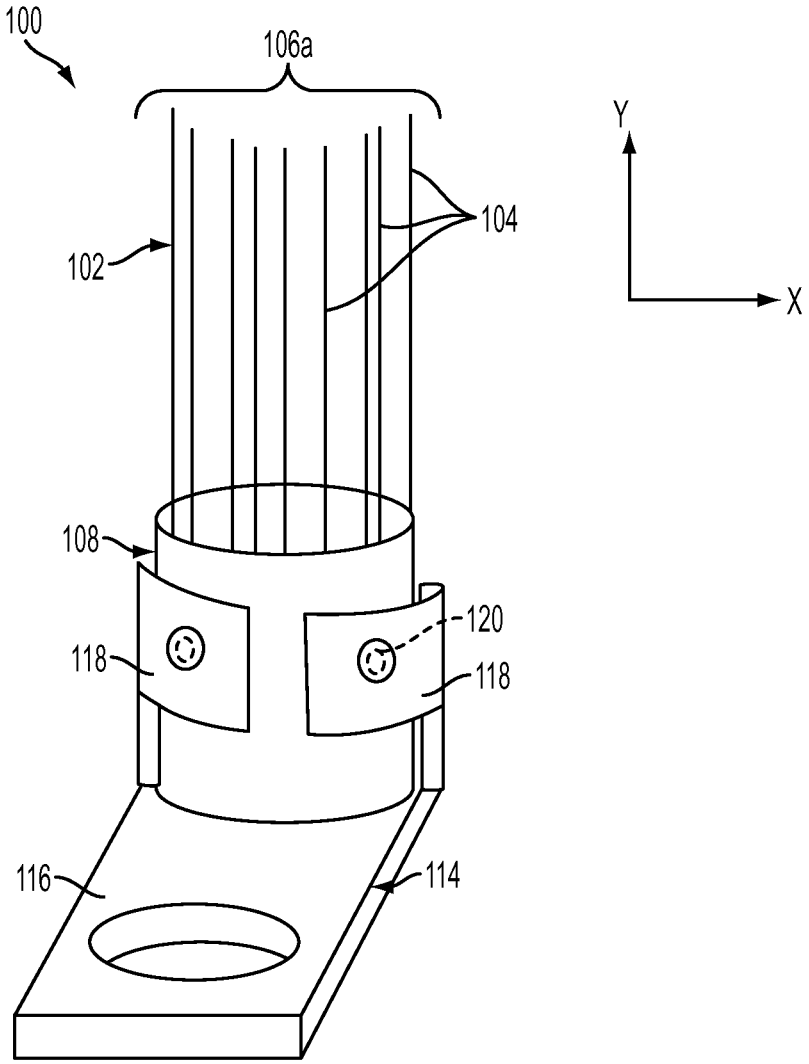
FIG. 6 illustrates the wire bundle following a crimping process that mechanically crimps the flanges of the ferrule.

Referring now to FIG. 6, a final Litz wire terminal assembly 100 is shown according to a non-limiting embodiment. The final Litz wire terminal assembly 100 is formed following a crimping process that mechanically crimps the flanges 118 at one or more spots 120 of the ferrule 108. The flanges 118 provide additional strain relief between the ferrule 108 and the lug 114, thereby strengthening and stabilizing the overall mechanical connection of the Litz wire terminal assembly 100.

As described above, various embodiments of the invention provide a Litz wire termination assembly that maintains the braid pattern at the termination end without the need for splaying a portion of the wire bundle. Furthermore, the end of the wire bundle can be metallurgically bonded to a metal surface without requiring conventional insulation stripping processes known to damage the underlying conductive strands. In this manner, the original braid pattern is maintained leading to significant performance enhancements including, for example, increased protection against skin effects.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A Litz wire terminal assembly, comprising:

a wire bundle including a plurality of electrically conductive strands extending between a first end and a second end to define a length, each strand including an insulative cover having a proximate cover end at the first end and a distal cover end at the second end, the distal cover end being flush with the second end; and a ferrule on the wire bundle, the ferrule having a distal ferrule end at the second end of the conductive strands, wherein the distal ferrule end is flush with both the second end of strands and the distal cover ends of the insulative covers, and wherein the insulative cover extends continuously from the first end to the second end.

2. The Litz wire terminal assembly of claim 1, wherein the strands are arranged according to a braid pattern that defines a shape of the wire bundle.

3. The Litz wire terminal assembly of claim 2, wherein the first end of the strands define a proximate bundle end of the wire bundle and the second end of the strands define a distal end of the wire bundle.

4. The Litz wire terminal assembly of claim 3, wherein the distal end of the wire bundle has a substantially flat cross-section defining a bundle surface.

5. The Litz wire terminal assembly of claim 4, wherein the shape of the wire bundle is substantially uniform between the proximate bundle end and the distal bundle end.

6. The Litz wire terminal assembly of claim 5, wherein the distal strand ends define a circumference of the distal bundle end.

7. The Litz wire terminal assembly of claim 5, further comprising an electrically conductive lug having a lug surface formed against the bundle surface.

8. A method of forming a Litz wire terminal assembly, the method comprising:

forming a wire bundle including a plurality of electrically conductive strands extending between a first end and a second end, each strand including an insulative cover having a proximate cover end at the first end and a distal cover end at the second end, the distal cover end being end being flush with the second end of the strands, wherein the insulative cover extends continuously from the first end to the second end;

forming a ferrule on the wire bundle, the ferrule extending between a proximate ferrule end and a distal ferrule end at the second end of the wire bundle such that an excess portion of the second ends of the strands extend beyond the distal ferrule end, the distal ferrule end being flush with both the second end of strands and the distal cover ends of the insulative covers;

cutting the excess portion to form a substantially flat bundle surface; and welding the bundle surface to an electrically conductive surface.

9. The method of claim 8, wherein the strands are arranged according to a braid pattern that defines a shape of the wire bundle.

10. The method of claim 9, wherein the first end of the strands define a proximate bundle end of the wire bundle and the second end of the strands define a distal end of the wire bundle.

11. The method of claim 10, wherein the shape of the wire bundle is substantially uniform between the proximate bundle end and the distal bundle end.

12. The method of claim 11, wherein the shape of the wire bundle is substantially cylindrical.

13. The method of claim 12, wherein the distal strand ends define a circumference of the distal bundle end.

* * * * *